US008440582B2

(12) United States Patent
Jones et al.

(10) Patent No.: US 8,440,582 B2
(45) **Date of Patent: *May 14, 2013**

(54) FLAME RESISTANT FILLER CLOTH AND MATTRESSES INCORPORATING SAME

(75) Inventors: Melanie Pearce Jones, Greensboro, NC (US); James Douglas Small, Jr., Greensboro, NC (US); John H. Walton, Greensboro, NC (US); Alfred Frank Baldwin, Jr., Franklinville, NC (US); Zareh Mikaelian, High Point, NC (US); William Scott Kinlaw, Greensboro, NC (US)

(73) Assignee: Precision Fabrics Group, Inc., Greensboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/483,138

(22) Filed: May 30, 2012

(65) Prior Publication Data

US 2012/0246832 A1 Oct. 4, 2012

Related U.S. Application Data

(63) Continuation of application No. 11/043,560, filed on Jan. 26, 2005, now Pat. No. 8,236,712.

(60) Provisional application No. 60/619,644, filed on Oct. 18, 2004.

(51) Int. Cl.
*B32B 27/00* (2006.01)
*D04H 17/00* (2006.01)

(52) U.S. Cl.
USPC ..... 442/136; 442/402; 442/403; 442/405; 442/407; 442/414; 428/920; 428/921

(58) Field of Classification Search ..... 442/136, 442/402, 403, 405, 407, 414; 428/920, 921
See application file for complete search history.

(56) References Cited

U.S. PATENT DOCUMENTS

| | | | | |
|---|---|---|---|---|
| 3,728,073 | A | 4/1973 | Pleskun | |
| 4,670,318 | A | 6/1987 | Uchiya et al. | 428/102 |
| 5,035,943 | A | 7/1991 | Kinlaw et al. | 442/79 |
| 5,645,926 | A | 7/1997 | Horrocks et al. | 442/234 |
| 6,472,456 | B1 | 10/2002 | Horsey et al. | |
| 6,593,256 | B1 | 7/2003 | Wildeman | |
| 2003/0082972 | A1 | 5/2003 | Monfalcone et al. | 442/138 |
| 2003/0171055 | A1 | 9/2003 | Endo et al. | 442/403 |
| 2004/0097156 | A1 | 5/2004 | McGuire et al. | |
| 2004/0106347 | A1 | 6/2004 | McGuire et al. | 442/361 |
| 2005/0026528 | A1 | 2/2005 | Forsten et al. | 442/414 |
| 2005/0095936 | A1 | 5/2005 | Jones et al. | |

FOREIGN PATENT DOCUMENTS

| | | | |
|---|---|---|---|
| WO | WO 97/22753 | | 6/1997 |
| WO | WO 02/092901 | | 11/2002 |
| WO | WO 2004/050980 | A1 | 6/2004 |
| WO | WO 2004/099491 | A2 | 11/2004 |

OTHER PUBLICATIONS

International Search Report and Written Opinion of the International Searching Authority corresponding to PCT/US2005/030136, mailed May 24, 2006.

Canadian Patent Application No. 2,586,232; filed Apr. 18, 2007; office action mailed Jul. 12, 2012.

*Primary Examiner* — Matthew Matzek

(74) *Attorney, Agent, or Firm* — Myers Bigel Sibley & Sajovec, P.A.

(57) ABSTRACT

A filler cloth includes cellulosic fibers treated with a flame retardant chemistry such that the filler cloth has a char length of less than about nine inches when tested in accordance with NFPA 701, such that thermal shrinkage of the filler cloth at 400° F. is less than about 35% in any direction, and such that the filler cloth maintains flame and heat resistant integrity when impinged with a gas flame in accordance with testing protocols set forth in Technical Bulletin 603 of the State of California Department of Consumer Affairs. The filler cloth cellulosic fibers are treated with a flame retardant chemistry such that the filler cloth has a Frazier air permeability of less than about 400 cfm and a thermal resistance rating of at least about 3 when tested according to NFPA 2112.

88 Claims, No Drawings

FLAME RESISTANT FILLER CLOTH AND MATTRESSES INCORPORATING SAME

RELATED APPLICATIONS

This application claims priority under 35 U.S.C. §120 to, and is a continuation of, U.S. patent application Ser. No. 11/043,560, filed Jan. 26, 2005, now U.S. Pat. No. 8,236,712 which claims the benefit of priority under 35 U.S.C. §119(e) to U.S. Provisional Patent Application No. 60/619,644, filed Oct. 18, 2004, the disclosure of each of which is incorporated herein by reference in its entirety.

FIELD OF THE INVENTION

The present invention relates generally to furniture and, more particularly, to rendering upholstered articles fire resistant.

BACKGROUND OF THE INVENTION

There is heightened awareness of fire prevention in homes and businesses in the United States. This awareness has led to the development of standards and legislation directed to reducing the risk of fires, particularly with respect to bedding and upholstered furniture. Conventional fire prevention techniques for bedding and upholstered furniture involve the topical application of flame retardant chemicals directly to an outer decorative layer of upholstery material.

However, recently passed legislation may render conventional fire protection techniques for bedding (particularly mattresses) inadequate. For example, the cigarette burn test for measuring flame resistance (developed by the Upholstered Furniture Action Council) has been deemed inadequate by the state of California and by the U.S. Consumer Product Safety Commission. In addition, new regulations being promulgated in some states prohibit the sale or manufacture of mattresses that do not pass these new flammability tests.

For example, California Technical Bulletin 603 of the State of California Department of Consumer Affairs (hereinafter "TB-603"), which is incorporated herein by reference in its entirety, exposes the top and side panels of a mattress to an open gas flame to simulate the effects of burning bedclothes. TB-603 is extremely aggressive relative to conventional cigarette burn tests and many industry analysts are skeptical that conventional upholstered furniture and bedding products (e.g., mattresses, etc.) will be able to pass TB-603.

In addition, material that can prevent the propagation of flame into the core cushioning material of furniture, and institutional bedding is desired. California Technical Bulletin 117 of the State of California Department of Consumer Affairs (hereinafter "TB-117"), which is incorporated herein by reference in its entirety, provides testing for upholstered furniture, and California Technical Bulletin 129 of the State of California Department of Consumer. Affairs (hereinafter "TB-129"), which is incorporated herein by reference in its entirety, provides testing for institutional bedding.

In some cases, even though an upholstery fabric or ticking is constructed of inherently flame resistant material, it may be permeable such that heat and hot gases may be transmitted through the fabric causing internal materials to ignite. Furthermore, conventional methods of assembling mattresses and upholstered furniture may produce seams and joints that cannot withstand these new flammability tests without splitting open and subjecting flammable interior materials to flame. Also, pores formed in bedding fabrics as a result of sewing, seaming, quilting, and/or the attachment of labels, handles, decorations, vents, etc., may be penetrated by flames and hot gases which may result in the combustion of interior materials.

The top and side panels of a mattress are typically composed of layers of material. Typically the outer layer is a decorative ticking fabric that is a high quality knit or woven textile. The next layer is typically a cushioning layer, such as foam, batting, or other lofty, soft material. The cushioning layer provides a plump, soft, feel and texture to the panel. The next layer is typically a backing fabric that supports the cushioning material and provides strength and dimensional stability to the panel. The backing layer is conventionally a polyester or polypropylene nonwoven fabric, a knit, or a woven fabric. The layers of a mattress panel are typically assembled, for example, with stitch quilting, ultrasonic quilting, or are glued, bonded, heat bonded, or simply laid into a structure and attached at the seams. Conventionally, a flame and heat blocking component is added to the panel when the panel is designed to resist heat, fire, or ignition.

Mattress side and top panels typically are attached to panels underneath the mattress and/or atop a foundation that are commonly referred to as filler cloth. Filler cloth can be an alternative material to ticking fabric that is used for the top and sides of mattresses. Mattress construction may use filler cloth in various ways. For example, for mattresses that are not designed to be turned over, decorative fabric panels on the top and sides of the mattress are attached with a seam or a gusset. The side panel is drawn around the bottom of the mattress and attached to filler cloth by seaming. On the bottom of the mattress the seamed-in filler cloth is framed by the decorative side panel and does not extend to the edges of the mattress. This is commonly referred to as "continental" construction.

Also, for mattresses that are not designed to be turned over, a mattress may include a decorative top panel, a decorative side panel, and filler cloth on the bottom that is attached at the bottom edge of the mattress with a seam. Mattress foundations may utilize filler cloth in the top panel thereof.

To prevent the ignition of the core of a mattress, a variety of flame resistant materials have been utilized in the construction of mattress top and side panels. For example, fabrics made from graphite, carbon, para-aramid, or other flame and heat resistant fibers have been used. Batting composed of flame resistant fibers or fibers that char, such as silica-modified rayon (or Visil), modacrylic, FR rayon, FR polyester, melamine, or other suitable fibers may be produced that at high basis weights can provide flame resistance and insulation. Foams may be chemically treated with flame retardant or impregnated with graphite. Fabrics may also be treated with flame retardant and/or intumescent chemical compositions or impregnated with intumescent chemicals to provide flame blocking and insulative properties.

When designing a mattress for flame resistance, it has been common practice to place thick cushioning batts of flame resistant fiber, or fabrics composed of flame resistant fiber, or fabrics finished for flame retardancy, or fabrics coated with flame resistant or intumescent chemical, in the top and/or side panels where the major challenge of open flame is seen.

Unfortunately, when flame and heat resistance is achieved through the use of a batting of flame resistant fibers, the amount of batting material that is required to provide the flame resistance is significantly higher than the amount that would generally be needed to provide cushioning, texture, and aesthetics. In many cases, as much as twice the amount of fibrous batting is required to provide the flame resistance than is required to provide cushioning. While a normal amount of fibrous batting would be around 4 to about 6 ounces per square yard, 9 ounces per square yard, or more can be required for flame resistance. This has the consequences of forcing an "overstuffed" appearance, which may make sewing and construction difficult, and which may add significant costs to mattress construction.

In many mattress constructions, the cushioning and seaming of the mattress and foundation, can cause an opening in the fit between the two. This can be a design fault, or the design may result in the exposure of the filler cloth areas to the exterior of the mattress, mattress set, or sleep system. Additionally, mistakes in the actual construction of sleep systems, mattresses, or mattress sets can result in the exposure of the filler cloth areas. This exposure, can allow flame to penetrate to the area between the foundation and the mattress. Alternately, a mattress may be suspended on slats, spring wire, or other non-traditional foundation that would allow flames to directly contact the bottom of the mattress. When this happens, the filler cloth is exposed to the flame. If the filler cloth burns, or melts away, or shrinks away, then the flame can penetrate into the inside of the mattress side panel and propagate into the core of the mattress causing catastrophic failure.

SUMMARY OF THE INVENTION

In view of the above discussion, a filler cloth for use in mattress construction that has strong, flame resistant characteristics is described herein. According to embodiments of the present invention, a filler cloth includes cellulosic fibers treated with a flame retardant chemistry such that the filler cloth has a char length of less than about nine inches (9 in.) when tested in accordance with NFPA 701, such that thermal shrinkage of the filler cloth at 400° F. is less than about 35% in any direction, and such that the filler cloth maintains flame and heat resistant integrity when impinged with a gas flame in accordance with testing protocols set forth in Technical Bulletin 603 of the State of California Department of Consumer Affairs (TB-603). Preferably, the filler cloth has a thickness of less than about 0.125 inch, and includes a non-skid surface having a coefficient of friction greater than or equal to about 0.4. However, it is understood that other thicknesses are possible and that other surface coefficients of friction are possible.

Filler cloth, according to embodiments of the present invention, also has a Frazier air permeability of less than about 400 cfm and a thermal resistance rating of at least about 3 when tested according to NFPA 2112. In addition, if the filler cloth is produced by stitchbonding or other process where a yarn is used to bond the structure, it is preferable that the yarn have very low thermal shrinkage at elevated temperature. A yarn that is not thermoplastic would be preferred, such as aramid, however, any yarn that is used should have a thermal shrinkage of less than about 20%. Preferably, the shrinkage would be less than about 15%, and more preferably, the shrinkage would be less than about 10%; when exposed to 475° F. heat in accordance with the PFG high temperature yarn shrinkage test (PFG Test).

DETAILED DESCRIPTION OF THE INVENTION

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. As used herein, the term "and/or" includes any and all combinations of one or more of the associated listed items.

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

As used herein, the term "flame resistant material" means a material that passes the requirements of National Fire Protection Association (NFPA) 701-1989.

As used herein, the term "heat resistant material" means a material that does not melt, ignite, or decompose up to a temperature of 250° C. at ambient atmospheric oxygen levels.

Filler cloth for use in constructing mattresses, according to embodiments of the present invention, includes cellulosic fibers treated with a flame retardant chemistry such that the filler cloth has a char length of less than about nine inches (9 in.) when tested in accordance with NFPA 701, such that thermal shrinkage of the filler cloth at 400° F. is less than about 35% in any direction, and such that the filler cloth maintains flame and heat resistant integrity when impinged with a gas flame in accordance with testing protocols set forth in Technical Bulletin 603 of the State of California Department of Consumer Affairs (TB-603). Preferably, the filler cloth has a thickness of less than about 0.125 inch, and includes a non-skid surface having a coefficient of friction greater than or equal to about 0.4. However, it is understood that other thicknesses are possible and that other surface coefficients of friction are possible.

Filler cloth, according to embodiments of the present invention, is constructed from cellulosic fiber, which may include, but is not limited to, cotton, viscose, silica-modified viscose, wood pulp, or any of the other lesser used fibers such as flax, ramie or jute. Any cellulosic fiber can work. A non-cellulosic part of the filler cloth may be non-thermoplastic fiber such as aramid, carbon, polybenzimidazole, or melamine. A thermoplastic fiber such as polyester, nylon, or polypropylene may be used but does not exceed 40% of the blend. More preferably, the thermoplastic fiber is 30% or less. The fabric may be constructed by any of the known textile or nonwoven processes, such as weaving, knitting, stitchbonding, spunlacing, thermal bonding, resin bonding, powder bonding, needlepunching, ultrasonic bonding, or weft insertion. Preferred embodiments, for example, include stitchbonding, needlepunching, and spunlacing. The fabric should be relatively thin, and handle as a textile when used to cover the bottom of a mattress or top of a mattress foundation. The fabric should also supply sufficient strength to hold a seam, resist bursting from handling, and have good fabric aesthetics.

Preferably, the cellulosic fibers are treated with a flame retardant chemistry such that the filler cloth has a Frazier air permeability of less than about 400 cfm and a thermal resistance rating of at least about 3 when tested according to NFPA 2112. The flame retardant chemistry may be durable or non-durable. Durable finishes are not removed by exposure to water or handling. Typical non durable finishes include, mono and diammonium phosphate, ammonium bromide, ammonium chloride, boric acid, borax, ammonium borate, ethanolammonium borate, phosphate or sulfamate, ammonium sulfamate, organic phosphate esters, halogenated organic compounds. Durable finishes may include, halogenated organic compounds like decabromodiphenyl oxide, chlorinated or brominated paraffin, chlorinated or brominated binders, thiourea, hydrated alumina, graphite, antimony oxides, and the like. The chemistry may be added to the substrate using application methods known to those skilled in the art. Padding, gravure coating, foam coating, slot coating, printing, spraying, paste coating, powder application, kiss coating, and screen coating are all examples of acceptable methods. The flame retardant may be added alone, or in combination with other finishing chemistries like antistats, lubricants, binders, antimicrobials, color, water and oil repellents, surfactants, and other chemical auxiliaries known to the art. Following the application of the chemistry, which may be done using water or other solvents as a vehicle for uniformly distributing the treatment, the substrate is dried, and prepared for shipment.

In addition, if the filler cloth is produced by stitchbonding or other process where a yarn is used to bond the structure, it is preferable that the yarn have very low thermal shrinkage at elevated temperature. A yarn that is not thermoplastic would be preferred, such as aramid, however, any yarn that is used should have a thermal shrinkage of less than about 20%. Preferably, the shrinkage would be less than about 15%, and more preferably, the shrinkage would be less than about 10%; when exposed to 475° F. heat in accordance with the PFG high temperature yarn shrinkage test (PFG Test).

PFG Test

1) Cut a strand of yarn 6 to 8" long
2) Lay yarn out flat and mark two spots with an ink marker at any measured distance apart (e.g., 4", etc).
3) After placing the marked yarn specimen in a petri dish, place in an oven at 475° F. for 5 min.
4) After the 5 min exposure, remove the dish and allow to cool.
5) Lay the yarn specimen out flat again, and measure the distance between the two marks.
6) Report the loss, if any, as % shrinkage.

Filler cloth, according to embodiments of the present invention, is flame retardant/resistant, and will not melt or shrink away in the presence of heat and flame. The flame resistance of mattress panels is significantly improved by using filler cloth according to embodiments of the present invention (e.g., by attaching the filler cloth directly to a side panel). This construction prevents a breach of the mattress panel by flame. Moreover, filler cloth, according to embodiments of the present invention, helps protect against mistakes in mattress construction or design.

The flammability characteristics of the filler cloth of the present invention are key to its performance and should combine the following characteristics: 1) self-extinguishing flame retardancy; 2) does not melt away from flame exposure and does not split or open up when exposed to flame; 3) has low thermal shrinkage at temperatures of 400° F. and higher; and 4) has good thermal protective performance and insulates or blocks heat transfer. Flame retardancy can be measured in a number of ways, however, a char length of less than 9 inches using NFPA 701, which is incorporated herein by reference in its entirety, is a useful way to quantify this. The thermal shrinkage at 400° F. should be less than about 35% and more preferably less than about 20%. The thermal protective performance measured by NFPA 2112, which is incorporated herein by reference in its entirety, non contact should be above 3.

Additionally, when exposed to a burner as described in California TB 603, no holes or large cracks should be created. Small, fissure like cracks may occur but they should not allow flame to pass. Another property that can be incorporated into a flame resistant filler cloth, according to embodiments of the present invention, is low air permeability. Frazier air permeability of below 300 cfm, and more preferably below 200 cfm, can help a mattress, mattress foundation, or other type of sleep system to resist ignition by restricting the air being pulled into the product during exposure to flame. Accordingly, this can starve the interior of a mattress (or other bedding/upholstered product) for air and quench a flame.

Preferably, filler cloth, according to embodiments of the present invention, should be strong enough to hold a sewn seam, resist bursting and puncture by springs or other construction materials in a mattress, should be abrasion resistant, should have a non-skid surface as measured by a coefficient of friction greater than or equal to 0.4, and should be thinner than about 0.125".

Example

Two basis weight variations of stitchbonded fabric were produced at Superior Fabrics, FL, USA, that were constructed by preparing a batt of 100% Lyocell fiber and stitched using a 75 denier polyester yarn. The polyester yarn used had thermal shrinkage of 8.7% when tested according to the PFG Test, described above. The two weights were 2.7 and 3.6 ounces per square yard (osy). The fabrics contained about 9% to 20% polyester and the remainder of the fabric weight was cellulose. Both fabrics were 85" wide. Both fabrics were finished for flame retardancy by treating them with a combination of acrylic binder, ammonium polyphosphate, and urea. Add-on ranged from about 25% to about 45% on weight of the fabric. The fabric was dried in a tenter frame at 400° F. for 45 seconds. The resulting fabric properties are listed below:

| PROPERTY | | 402042 | 402043 |
|---|---|---|---|
| Basis Weight (osy) | | 3.84 | 4.8 |
| Thickness (in) | | .022 | .026 |
| Grab Tensile (lbs/in) | MD | 50.2 | 49.8 |
| | XD | 38.9 | 52.5 |
| Elongation (%) | MD | 47.7 | 39.7 |
| | XD | 24.1 | 9.3 |
| Trap Tear (lbs) | MD | 13.1 | 19.1 |
| | XD | 12.0 | 10.0 |
| Mullen Burst (net psi) | | 62 | 59 |
| Air Perm (cfm) | | 244 | 175 |
| Thermal Shrinkage | MD | 13 | 10 |
| (%) | XD | 0 | 1 |
| NFPA 701 Flame | MD | 4.3 | 3.8 |
| (in) | XD | 4.5 | 4.1 |

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A nonwoven fabric, comprising:

a fibrous layer of cellulosic material comprising fibers that are bonded together by stitchbonding with a thermoplastic yarn that has a thermal shrinkage of less than about 20% when exposed to 475° F. heat in accordance with the PFG test, wherein the fibers comprise fibers selected from the group consisting of lyocell fibers and silica-modified viscose fibers, wherein the thermal shrinkage of the fabric at 400° F. is less than about 35% in any direction, wherein the fibrous layer of cellulosic material is coated with a flame retardant chemistry comprising one or more compounds selected from the group consisting of boron compounds, phosphorous compounds, nitrogen compounds, antimony compounds and halogen compounds.

2. The nonwoven fabric of claim 1, wherein the fibers comprise lyocell fibers.

3. The nonwoven fabric of claim 1, wherein the fibers further comprise cellulosic fibers selected from the group consisting of cotton fibers, non-silica-modified viscose fibers, wood fibers, flax fibers, ramie fibers, jute fibers and combinations thereof.

4. The nonwoven fabric of claim 1, wherein the fibers further comprise non-thermoplastic fibers selected from the group consisting of aramid fibers, carbon fibers, polybenzimidazole fibers, melamine fibers and combinations thereof.

5. The nonwoven fabric of claim 1, wherein the fibers further comprise aramid fibers.

6. The nonwoven fabric of claim 1, wherein the fibers further comprise thermoplastic fibers selected from the group consisting of polyester fibers, nylon fibers, polypropylene fibers and combinations thereof.

7. The nonwoven fabric of claim 6, wherein the thermoplastic fibers do not exceed 40% of the fibers included in the fibrous layer of cellulosic material.

8. The nonwoven fabric of claim 1, wherein the fibers further comprise polyester fibers.

9. The nonwoven fabric of claim 1, wherein the yarn comprises about 9% to about 20% of the weight of the fibrous layer of cellulosic material.

10. The nonwoven fabric of claim 1, wherein the thermoplastic yarn is a polyester yarn.

11. The nonwoven fabric of claim 10, wherein the polyester yarn comprises about 9% to 20% of the weight of the fibrous layer of cellulosic material.

12. The nonwoven fabric of claim 1, wherein the thermoplastic yarn has a thermal shrinkage of less than about 15% when exposed to 475° F. heat in accordance with the PFG test.

13. The nonwoven fabric of claim 1, wherein the thermoplastic yarn has a thermal shrinkage of less than about 10% when exposed to 475° F. heat in accordance with the PFG test.

14. The nonwoven fabric of claim 1, wherein the thermal shrinkage of the fabric at 400° F. is less than about 20% in any direction.

15. The nonwoven fabric of claim 1, wherein the flame retardant chemistry comprises one of more phosphorous compounds.

16. The nonwoven fabric of claim 1, wherein the flame retardant chemistry comprises ammonium polyphosphate.

17. The nonwoven fabric of claim 1, wherein the flame retardant chemistry is applied so as to achieve an add-on weight of about 25% to about 45% of the weight of the fibrous layer of cellulosic material.

18. The nonwoven fabric of claim 1, wherein the fabric maintains flame and heat resistance integrity when impinged with a gas flame in accordance with testing protocols set forth in Technical Bulletin 603 of the State of California Department of Consumer Affairs (TB-603).

19. The nonwoven fabric of claim 1, wherein the fabric has a char length of less than about nine inches when tested in accordance with NFPA 701.

20. The nonwoven fabric of claim 1, wherein the fabric has a Frazier air permeability of less than about 400 cfm.

21. The nonwoven fabric of claim 1, wherein the fabric has a thickness of less than about 0.125 inch.

22. The nonwoven fabric of claim 1, wherein the fabric has a non-skid surface having a coefficient of friction greater than or equal to about 0.4.

23. The nonwoven fabric of claim 1, wherein the fabric has a thermal resistance rating of at least about 3 when tested according to NFPA 2112.

24. The nonwoven fabric of claim 1, wherein the fabric has a char length of less than about nine inches when tested in accordance with NFPA 701, a Frazier air permeability of less than about 400 cfm, a thickness of less than about 0.125 inch, a non-skid surface having a coefficient of friction greater than or equal to about 0.4 and a thermal resistance rating of at least about 3 when tested according to NFPA 2112.

25. A nonwoven fabric, comprising:

a fibrous layer of cellulosic material comprising fibers that are bonded together by stitchbonding with a polyester yarn that has a thermal shrinkage of less than about 20% when exposed to 475° F. heat in accordance with the PFG test, wherein the polyester yarn comprises about 9% to about 20% of the weight of the fibrous layer of cellulosic material, wherein the thermal shrinkage of the fabric at 400° F. is less than about 35% in any direction, and wherein the fibrous layer of cellulosic material is coated with a flame retardant chemistry comprising one or more compounds selected from the group consisting of boron compounds, phosphorous compounds, nitrogen compounds, antimony compounds and halogen compounds.

26. The nonwoven fabric of claim 25, wherein the fibers comprise cellulosic fibers selected from the group consisting of cotton fibers, viscose fibers, silica-modified viscose fibers, lyocell fibers, wood fibers, flax fibers, ramie fibers, jute fibers and combinations thereof.

27. The nonwoven fabric of claim 25, wherein the fibers comprise viscose fibers, silica-modified viscose fibers and/or lyocell fibers.

28. The nonwoven fabric of claim 25, wherein the fibers comprise non-thermoplastic fibers selected from the group consisting of aramid fibers, carbon fibers, polybenzimidazole fibers, melamine fibers and combinations thereof.

29. The nonwoven fabric of claim 25, wherein the fibers comprise aramid fibers.

30. The nonwoven fabric of claim 25, wherein the fibers comprise thermoplastic fibers selected from the group consisting of polyester fibers, nylon fibers, polypropylene fibers and combinations thereof.

31. The nonwoven fabric of claim 25, wherein the thermoplastic fibers do not exceed 40% of the fibers included in the fibrous layer of cellulosic material.

32. The nonwoven fabric of claim 25, wherein the fibers comprise polyester fibers.

33. The nonwoven fabric of claim 25, wherein the polyester yarn has a thermal shrinkage of less than about 15% when exposed to 475° F. heat in accordance with the PFG test.

34. The nonwoven fabric of claim 25, wherein the polyester yarn has a thermal shrinkage of less than about 10% when exposed to 475° F. heat in accordance with the PFG test.

35. The nonwoven fabric of claim 25, wherein the thermal shrinkage of the fabric at 400° F. is less than about 20% in any direction.

36. The nonwoven fabric of claim 25, wherein the flame retardant chemistry comprises one of more phosphorous compounds.

37. The nonwoven fabric of claim 25, wherein the flame retardant chemistry comprises ammonium polyphosphate.

38. The nonwoven fabric of claim 25, wherein the flame retardant chemistry is applied so as to achieve an add-on weight of about 25% to about 45% of the weight of the fibrous layer of cellulosic material.

39. The nonwoven fabric of claim 25, wherein the fabric maintains flame and heat resistant integrity when impinged with a gas flame in accordance with testing protocols set forth in Technical Bulletin 603 of the State of California Department of Consumer Affairs (TB-603).

40. The nonwoven fabric of claim 25, wherein the fabric has a char length of less than about nine inches when tested in accordance with NFPA 701.

41. The nonwoven fabric of claim 25, wherein the fabric has a Frazier air permeability of less than about 400 cfm.

42. The nonwoven fabric of claim 25, wherein the fabric has a thickness of less than about 0.125 inch.

43. The nonwoven fabric of claim 25, wherein the fabric has a thermal resistance rating of at least about 3 when tested according to NFPA 2112.

44. The nonwoven fabric of claim 25, wherein the fabric has a char length of less than about nine inches when tested in accordance with NFPA 701, a Frazier air permeability of less than about 400 cfm, a thickness of less than about 0.125 inch, a non-skid surface having a coefficient of friction greater than or equal to about 0.4 and a thermal resistance rating of at least about 3 when tested according to NFPA 2112.

45. A mattress comprising the nonwoven fabric of claim 1.

46. A mattress comprising the nonwoven fabric of claim 2.

47. A mattress comprising the nonwoven fabric of claim 3.

48. A mattress comprising the nonwoven fabric of claim 4.

49. A mattress comprising the nonwoven fabric of claim 5.

50. A mattress comprising the nonwoven fabric of claim 6.

51. A mattress comprising the nonwoven fabric of claim 7.

52. A mattress comprising the nonwoven fabric of claim 8.

53. A mattress comprising the nonwoven fabric of claim 9.

54. A mattress comprising the nonwoven fabric of claim 10.

55. A mattress comprising the nonwoven fabric of claim 11.

56. A mattress comprising the nonwoven fabric of claim 12.

57. A mattress comprising the nonwoven fabric of claim 13.

58. A mattress comprising the nonwoven fabric of claim 14.

59. A mattress comprising the nonwoven fabric of claim 15.

60. A mattress comprising the nonwoven fabric of claim 16.

61. A mattress comprising the nonwoven fabric of claim 17.

62. A mattress comprising the nonwoven fabric of claim 18.

63. A mattress comprising the nonwoven fabric of claim 19.

64. A mattress comprising the nonwoven fabric of claim 20.

65. A mattress comprising the nonwoven fabric of claim 21.

66. A mattress comprising the nonwoven fabric of claim 22.

67. A mattress comprising the nonwoven fabric of claim 23.

68. A mattress comprising the nonwoven fabric of claim 24.

69. A mattress comprising the nonwoven fabric of claim 25.

70. A mattress comprising the nonwoven fabric of claim 26.

71. A mattress comprising the nonwoven fabric of claim 27.

72. A mattress comprising the nonwoven fabric of claim 28.

73. A mattress comprising the nonwoven fabric of claim 29.

74. A mattress comprising the nonwoven fabric of claim 30.

75. A mattress comprising the nonwoven fabric of claim 31.

76. A mattress comprising the nonwoven fabric of claim 32.

77. A mattress comprising the nonwoven fabric of claim 33.

78. A mattress comprising the nonwoven fabric of claim 34.

79. A mattress comprising the nonwoven fabric of claim 35.

80. A mattress comprising the nonwoven fabric of claim 36.

81. A mattress comprising the nonwoven fabric of claim 37.

82. A mattress comprising the nonwoven fabric of claim 38.

83. A mattress comprising the nonwoven fabric of claim 39.

84. A mattress comprising the nonwoven fabric of claim 40.

85. A mattress comprising the nonwoven fabric of claim 41.

86. A mattress comprising the nonwoven fabric of claim 42.

87. A mattress comprising the nonwoven fabric of claim 43.

88. A mattress comprising the nonwoven fabric of claim 44.

* * * * *

UNITED STATES PATENT AND TRADEMARK OFFICE

CERTIFICATE OF CORRECTION

PATENT NO. : 8,440,582 B2
APPLICATION NO. : 13/483138
DATED : May 14, 2013
INVENTOR(S) : Jones et al.

It is certified that error appears in the above-identified patent and that said Letters Patent is hereby corrected as shown below:

In the Claims:

Column 7, Claim 15, Line 64:

Please correct "one of more" to read -- one or more --

Column 9, Claim 36, Line 13:

Please correct "one of more" to read -- one or more --

Signed and Sealed this
Twenty-first Day of June, 2016

Michelle K. Lee

Michelle K. Lee
*Director of the United States Patent and Trademark Office*